US009022728B2

(12) United States Patent
Zimmermann et al.

(10) Patent No.: US 9,022,728 B2
(45) Date of Patent: May 5, 2015

(54) FEATHER SEAL SLOT

(75) Inventors: Alisha M. Zimmermann, Vernon Rockville, CT (US); Conway Chuong, Manchester, CT (US); Shelton O. Duelm, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 696 days.

(21) Appl. No.: 13/283,745

(22) Filed: Oct. 28, 2011

(65) Prior Publication Data

US 2013/0108430 A1 May 2, 2013

(51) Int. Cl.
*F01D 11/00* (2006.01)

(52) U.S. Cl.
CPC ..... *F01D 11/005* (2013.01); *Y10T 29/49323* (2015.01); *F05D 2240/11* (2013.01)

(58) Field of Classification Search
CPC .... F01D 11/005; F01D 11/006; F01D 11/008
USPC ..... 415/134, 136, 137, 138, 139; 416/190, 416/191, 193 R, 193 A, 500
See application file for complete search history.

(56) References Cited

U.S. PATENT DOCUMENTS

| | | | | |
|---|---|---|---|---|
| 4,565,490 | A | 1/1986 | Rice | |
| 5,167,485 | A * | 12/1992 | Starkweather | 415/115 |
| 5,531,457 | A * | 7/1996 | Tibbott et al. | 277/590 |
| 7,186,078 | B2 * | 3/2007 | Tanaka | 415/170.1 |
| 7,261,514 | B2 * | 8/2007 | London et al. | 415/134 |
| 7,575,415 | B2 | 8/2009 | Drerup et al. | |
| 7,625,174 | B2 | 12/2009 | Drerup et al. | |
| 8,371,800 | B2 * | 2/2013 | Meenakshisundaram et al. | 415/1 |
| 2013/0108430 | A1 * | 5/2013 | Zimmermann et al. | 415/208.1 |

* cited by examiner

*Primary Examiner* — Edward Look
*Assistant Examiner* — Christopher R Legendre
(74) *Attorney, Agent, or Firm* — Carlson, Gaskey & Olds, P.C.

(57) ABSTRACT

A vane segment for a gas turbine engine includes an airfoil disposed between an outer platform and an inner platform. A slot for receiving a seal is defined within the outer platform and includes closed first and second ends and an upper surface spaced apart from a lower surface with a spacing between the upper surface and the lower surfaces that varies along a length of the slot.

7 Claims, 5 Drawing Sheets

FEATHER SEAL SLOT

BACKGROUND

This disclosure generally relates to seal configuration for a vane segment of a gas turbine engine. More particularly, this disclosure relates to a slot defined within the vane segment for receiving a feather seal.

Vanes are typically provided in a gas turbine engine for directing flow of compressed air or of high velocity gas flow. The vanes are exposed to high temperature gas flow and are assembled as a plurality of individual vane segments. Each vane segment includes an airfoil extending between an inner and outer platform. A seal is disposed between adjacent vane segments to prevent blow by of the high temperature gas flow. Each of the vane segments experience thermal expansion and contraction. The seal disposed between adjacent vane segments is also exposed to movement caused by relative thermal expansion between adjacent vane segments. The seal is typically supported within slots of adjacent vane segments. Non-uniform thermal expansion or contraction of adjacent vane segments can cause a mis-alignment of such slots that create a potential for undesired stresses on the seal during extreme tolerance and operational conditions.

SUMMARY

A vane segment for a gas turbine engine according to an exemplary embodiment of the present disclosure includes, among other possible things, an airfoil defining a pressure side and a suction side with a platform extending transverse to the airfoil. The platform including a slot for receiving a seal. The slot including closed first and second ends and an upper surface spaced apart from a lower surface with a spacing between the upper surface and the lower surface that varies along a length of the slot.

In a further embodiment of the foregoing vane segment, the slot includes a midpoint between the first and second ends and the spacing between the upper and lower surfaces is substantially uniform on a first side of the midpoint and varies on a second side of the midpoint.

In a further embodiment of the forgoing vane segment the second side of the slot is axially forward of the first side.

In a further embodiment of any of the foregoing vane segment embodiments a slot is included on each of the pressure side and suction side of the platform.

In a further embodiment of any of the foregoing vane segment embodiments a first thickness between an outer surface of the platform and the upper surface of the slot is substantially uniform along an entire length of the slot and a second thickness between an inner surface of the platform and the lower surface of the slot varies over the length of the slot to define the varying spacing between the upper and lower surfaces.

In a further embodiment of the foregoing vane segment embodiment the slot includes a midpoint between the closed first and second ends with the second thickness varying axially forward of the midpoint and being substantially uniform aft of the midpoint.

In a further embodiment of any of the foregoing vane segment embodiments, each of the vane segments include an outer platform and an inner platform, wherein the outer platform is radially outward of the inner platform, and wherein the slot is defined in the outer platform.

A vane assembly according to another exemplary embodiment of the present disclosure includes a plurality of vane segments each including an airfoil defining a pressure side and a suction side, an outer platform and an inner platform extending from opposite ends of the airfoil, and a slot disposed within the outer platform. The slot including closed first and second ends and an upper surface spaced apart from a lower surface with a spacing between the upper surface and the lower surface that varies along a length of the slot. The vane assembly including a seal disposed within adjacent slots of adjacent ones of the plurality of vane segments.

In a further embodiment of any of the foregoing vane assembly embodiments wherein each of the slots includes a midpoint between the closed first and second ends and the spacing between the upper and lower surfaces is substantially uniform on a first side of the midpoint and varies on a second side of the midpoint.

In a further embodiment of any of the foregoing vane assembly embodiments, the second side is axially forward of the first side.

In a further embodiment of any of the foregoing vane assembly embodiments, a slot is included on each of the pressure side and suction side of the outer platform.

In a further embodiment of any of the foregoing vane assembly embodiments a first thickness between an outer surface of the outer platform and the upper surface of the slot is substantially uniform along an entire length of the slot and a second thickness between an inner surface of the outer platform and the lower surface of the slot varies over the length of the slot to define the varying spacing between the upper and lower surfaces.

In a further embodiment of the foregoing vane assembly embodiment, the slot includes a midpoint between the closed first and second ends with the second thickness varying axially forward of the midpoint and remaining substantially uniform aft of the midpoint.

In a further embodiment of any of the foregoing vane assembly embodiments, a thickness of the seal is substantially uniform along an entire length of the seal.

A method of assembling a vane assembly for a gas turbine engine according to another exemplary embodiment of the present disclosure includes, among other possible steps, the step of defining a vane segment including an airfoil extending between an outer platform and an inner platform, providing a slot on both a pressure and suction side of each outer platform. The step further includes providing each of the slots with closed first and second ends and an upper surface spaced apart from a lower surface with a spacing between upper and lower surfaces varying over a length of the slot. The method further includes the steps of positioning a plurality of vane segments adjacent to each other to define a vane assembly including aligning slots on adjacent vane segments and assembling a seal across a gap between adjacent vane segments within the aligned slots of adjacent vane segments.

In a further embodiment of the foregoing method of assembling a vane assembly the slot is provided with a midpoint disposed between the closed first and second ends and defining the spacing between the upper and lower surfaces substantially uniformly on a first side of the midpoint and varying on a second side of the midpoint.

In a further embodiment of the foregoing method of assembling a vane assembly including providing the slot with a first thickness between an outer surface of each outer platform and the upper surface of the slot substantially uniformly along an entire length of the slot and providing a second thickness between an inner surface of the outer platform and the lower surface of the slot to vary over the length of the slot to define the varying spacing between the upper and lower surfaces.

In a further embodiment of the foregoing method of assembling a vane assembly, including the step of providing a common thickness over a complete length of the seal.

A gas turbine engine according to another a vane assembly includes a plurality of vane segments each including an airfoil defining a pressure side and a suction side, an outer platform and an inner platform extending from opposite ends of the airfoil, and a slot disposed within the outer platform. The slot including closed first and second ends and an upper surface spaced apart from a lower surface with a spacing between the upper surface and the lower surface that varies along a length of the slot. The vane assembly including a seal disposed within adjacent slots of adjacent ones of the plurality of vane segments.

Although different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
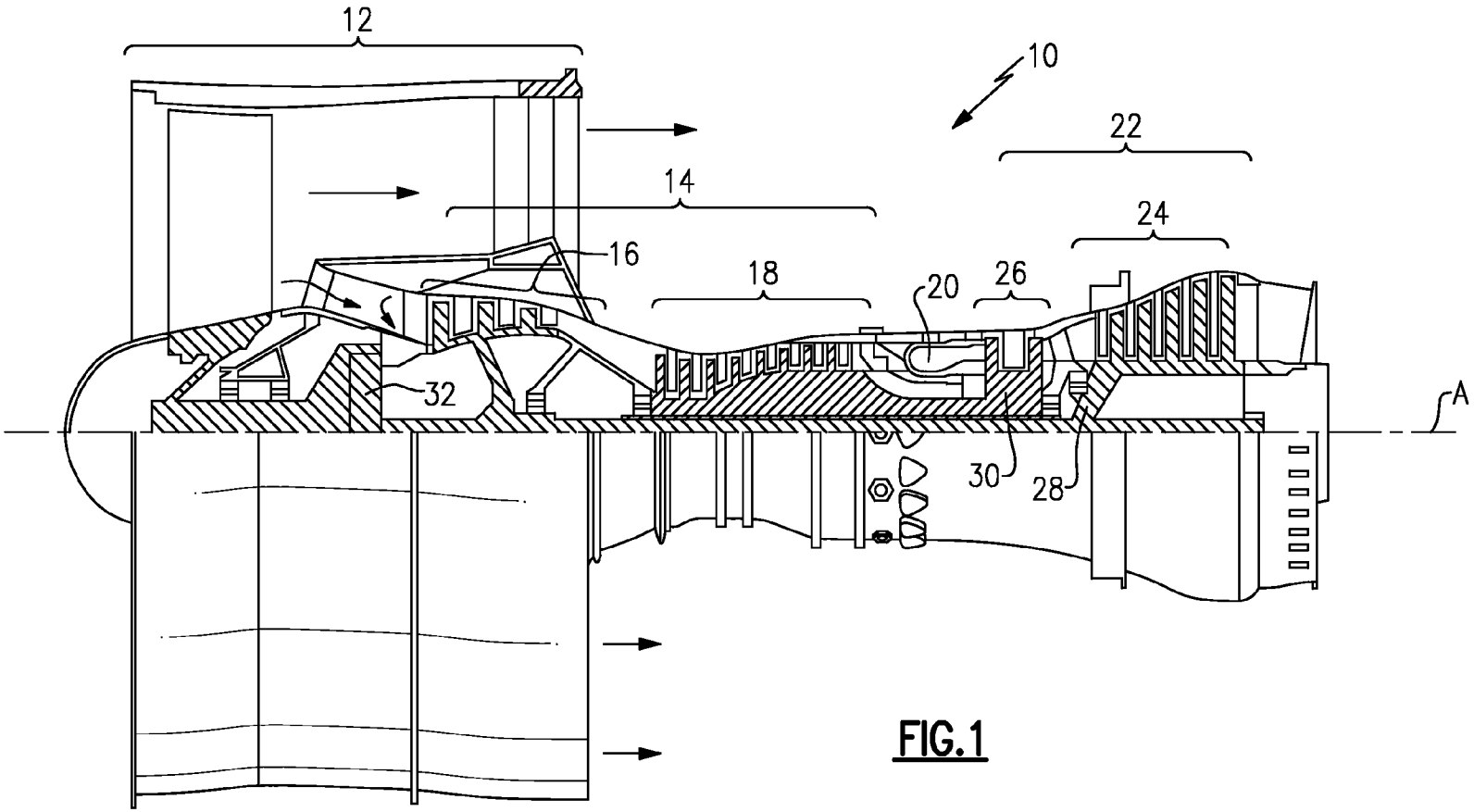
FIG. 1 is a schematic cross section of an example gas turbine engine.

Referring to FIG. 1, a gas turbine engine 10 includes a fan section 12, a compressor section 14, a combustor 20 and a turbine section 22. The example compressor section 14 includes a low pressure compressor section 16 and a high pressure compressor section 18. The turbine section 22 includes a high pressure turbine 26 and a low pressure turbine 24. The high pressure compressor section 18, high pressure turbine 26, the low pressure compressor section 16 and low pressure turbine 24 are supported on corresponding high and low spools 30, 28 that rotate about a main axis A.

Air drawn in through the compressor section 14 is compressed and fed into the combustor 20. In the combustor 20, the compressed air is mixed with fuel and ignited to generate a high speed gas stream. This gas stream is exhausted from the combustor 20 to drive the turbine section 24. The fan section 12 is driven through a gearbox 32 by the low spool 28.

Figure 2:
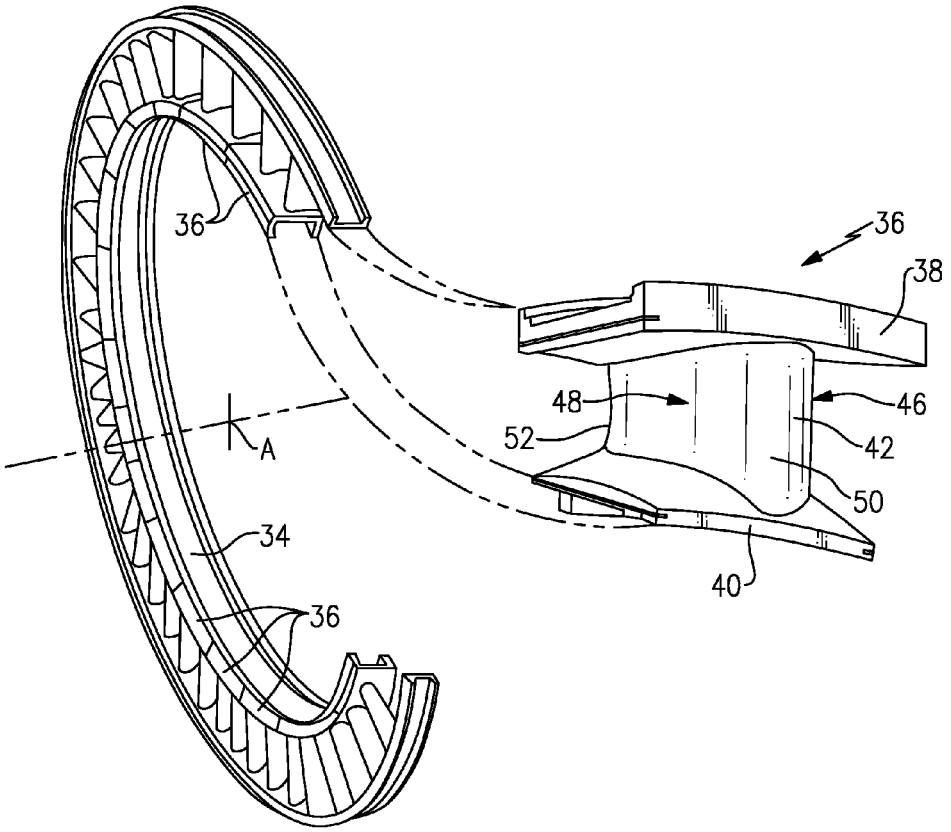
FIG. 2 is a schematic illustration of an example turbine vane stator assembly.

Referring to FIG. 2 with continued reference to FIG. 1, the example gas turbine engine 10 includes a turbine vane stator assembly 34 that directs the gas stream exhausted from the combustor 20 into the turbine section 22. The turbine vane stator assembly 34 provides for the preferential direction of the gas stream through the high and low pressure turbine sections 26, 24.

The example turbine vane stator assembly 34 is formed from a plurality of turbine vane segments 36. Each of the turbine vane segments 36 includes an outer platform 38 and an inner platform 40. The outer platform 38 is disposed radially outward of the inner platform 40. An airfoil 42 extends between the outer platform 38 and the inner platform 40. Each airfoil includes a suction side 46 and a pressure side 48, a leading edge 50 and a trailing edge 52 that is used to describe sides of the vane segment 36.

Figure 3:
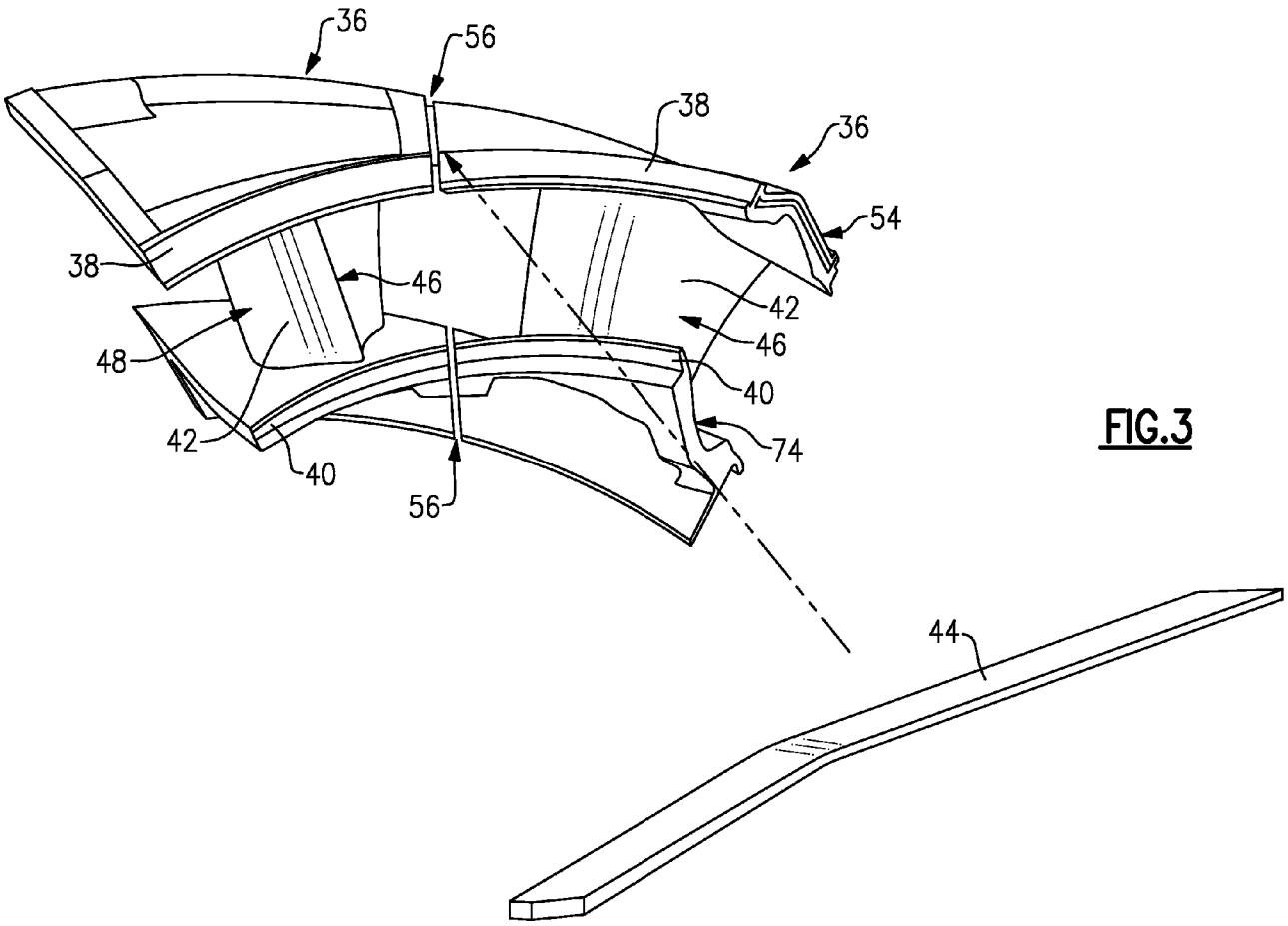
FIG. 3 is a perspective view of two example turbine vane segments.

Referring to FIG. 3 with continued reference to FIG. 2, a gap 56 is disposed between adjacent turbine vane segments 36. This gap 56 is blocked by a seal 44 to prevent leakage of the gas stream. The seal 44 is disposed within a slot 54 that is defined on the outer platform 38 of each side of each turbine vane segment 36. The seal 44 is of a uniform thickness along its entire length. A lower slot 74 is provided in the inner platform 40 for a corresponding seal (not shown).

The slot 54 is provided on both the pressure and suction sides 46, 48 of each turbine vane segment 36. The feather seal 44 is disposed within the slots 54 of adjacent turbine segments 36 to bridge the gap 56. Because each of the turbine vane segments 36 is a separate part, some relative movement caused by thermal expansion and contraction may occur. The example slots 54 include provisions to accommodate relative movement between adjacent turbine vane segments 36 while not damaging the seal 44.

Figure 4:
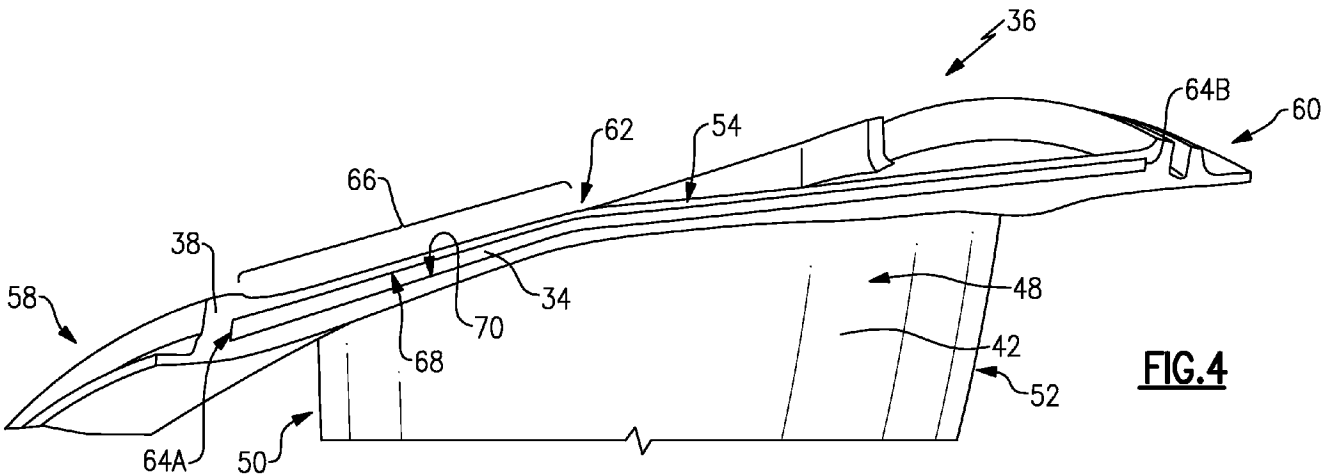
FIG. 4 is an enlarged view of a pressure side of an example turbine vane segment.
Figure 5:
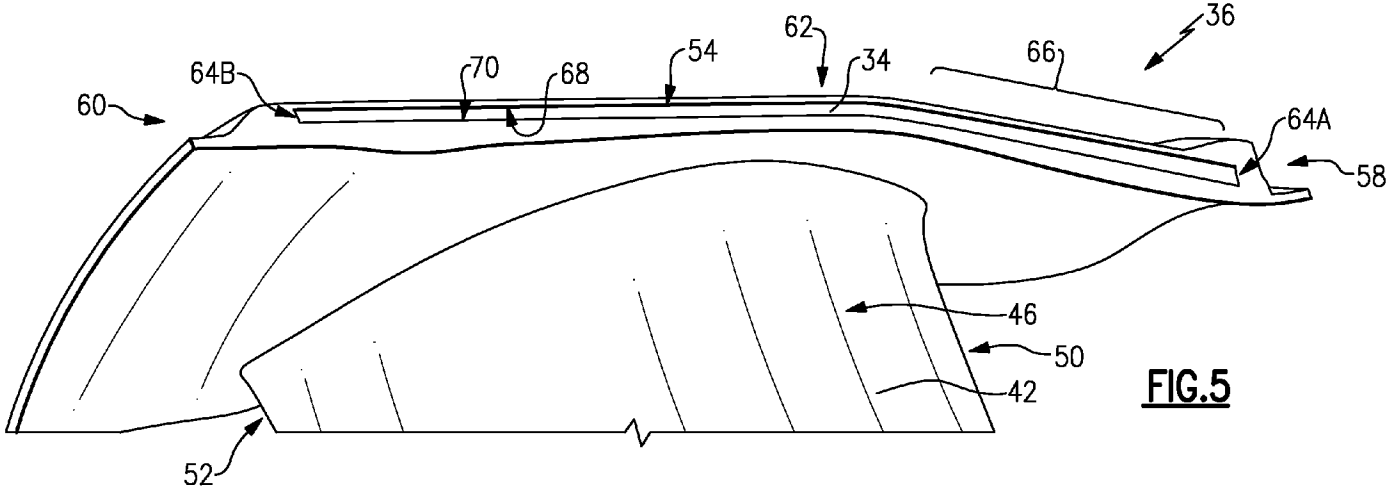
FIG. 5 is an enlarged view of a suction side of an example turbine vane segment.

Referring to FIGS. 4 and 5 with continued reference to FIG. 3, each of the slots 54 includes an upper surface 68 and a lower surface 70. FIG. 4 represents a pressure side of the turbine vane segment 36 and FIG. 5 represents a suction side 46 of the turbine vane segment 36. The slots 54 on each side of the turbine vane segment 36 minor each other such that each of the upper and lower surfaces 68, 70 of adjacent slots 54 are aligned with each other. The feather seal 44 seats on the lower surface 70 across adjacent slots 54 in adjacent vane segments 36.

The slot 54 extends from a forward end 58 toward an aft end 60. The slot 54 includes closed ends 64A-B and a midpoint 62 defined substantially by a knuckle or angled portion midway between the closed ends 64A-B. The closed end 64A is at the forward end 58 of the slot 54 and the closed end 64B is at the aft end 60 of the slot 54.

On the forward side of the midpoint 62 is a tapered portion 66. The tapered portion 66 provides the feather seal 44 with extra room to accommodate relative movement between adjacent turbine vane segments 36. The axial forward position of the tapered portion 66 corresponds with a leading edge 50 of the airfoil 42. Accordingly, the tapered portion 66 is disposed on a side of the midpoint opposite a trailing edge of the airfoil 42.

Figure 6:
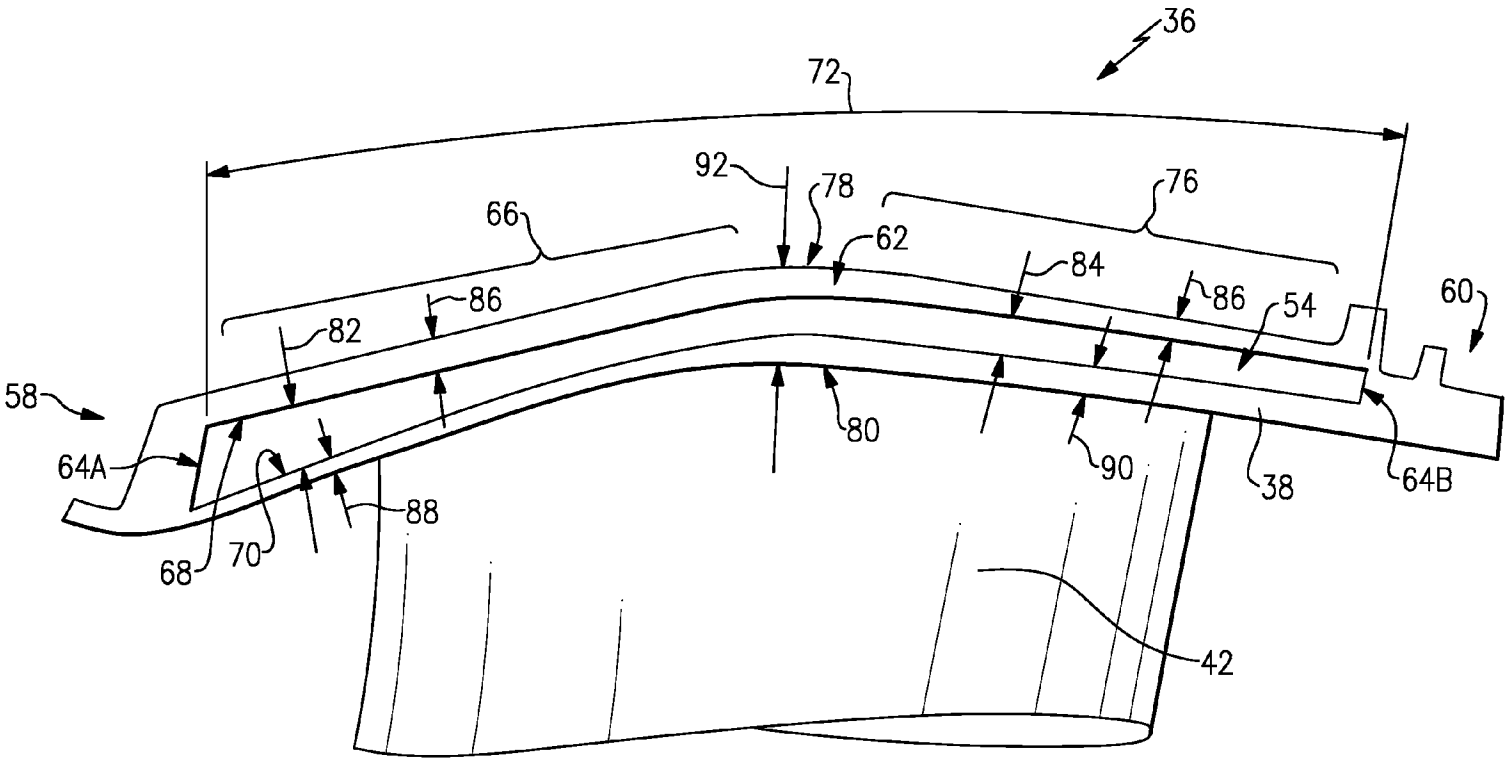
FIG. 6 is an enlarged view of a feather slot formed within a turbine vane segment.

Referring to FIG. 6 with continued reference to FIGS. 4 and 5, one of the example slots 54 is shown in an enlarged view. The slot 54 extends an overall length 72 and includes the midpoint 62 and the tapered portion 66. A second portion 76 is disposed aft of the midpoint 62 toward the trailing edge of the airfoil 42. The second portion 76 includes a substantially uniformed spacing 84 between upper and lower surfaces 68, 70. The substantially uniform spacing 84 is disposed from the closed end 64B forward to the midpoint 62. From the midpoint 62 forward towards the closed end 64A is the tapered portion 66 that includes a spacing 82 between the upper and lower surfaces 68, 70. The spacing 82 increases in a direction axially forward and away from the midpoint 62. The increasing spacing 82 between the upper and lower surfaces 68, 70 provides additional space for the feather seal 44.

Because the example feather seal 44 includes a substantially uniform thickness, it will have an increasing clearance within the slot 54 in the tapered portion 66 to accommodate movement of the outer platform 38 relative to an adjacent vane segment 36 during operation.

During typical operation, slots 54 of adjacent vane segments 36 would be aligned with one another such that the lower surfaces 70 will form a substantially flat surface across the gap 56. During operation where thermal expansion and contraction cause shifting or non-uniform expansion between adjacent segments 36, the tapered portion 66 with the increased spacing 82 will accommodate relative movement and misalignment between the slots 54 such that the feather seal 44 will remain within the slot 54 and will not experience undesirable stresses and loads.

The substantially uniform spacing 84 within the second portion 76 aids in maintaining the feather seal within the slot 54 and reduces the likelihood that the seal 44 may lift from the lower surface 70.

The outer platform 38 includes an overall thickness 92 between an outer surface 78 and an inner surface 80 within which the slot 54 is formed. A thickness 86 between the upper surface 68 of the slot 54 and the outer surface 78 of the outer platform 38 remains constant throughout the entire length of the slot 54. A thickness 88 between the lower surface 70 of the slot 54 and the inner surface 80 varies within the tapered portion 66. A thickness 90 between the lower surface 70 and the inner surface 80 remains constant within the second portion 76.

The thickness 88 varies to define the increased spacing 82 within the tapered portion 66. Accordingly, the thickness between the upper surface 68 and the outer surface 78 of the outer platform 38 remains substantially uniform along an entire length of the slot 54. However, the thickness between the lower surface 70 and the inner surface 80 varies from the second portion 76 to the tapered portion 66. In the tapered section, the thickness 88 is at its smallest and in the substantially uniform portion 76 the thickness 90 represents the greatest thickness between the lower surface 70 of the slot 54 and the inner surface 80 of the platform 38. This configuration of providing a substantially uniform thickness along the top of the slot 54 and varying the thickness along the bottom of the slot 54 provides the tapered portion 66 desired in the aft portion of the slot 54.

Accordingly, the example slot 54 includes a tapered portion that provides for the retention of a feather seal 44 while also providing accommodations for relative movement and expansion between adjacent vane segments within the limitations of the outer platform thickness.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A vane assembly comprising:

a plurality of vane segments each including an airfoil defining a pressure side and a suction side, an outer platform and an inner platform extending from opposite ends of the airfoil, and a slot disposed within the outer platform, the slot including closed first and second ends and an upper surface spaced apart from a lower surface wherein a spacing between the upper surface and the lower surface varies along a length of the slot, wherein a first thickness between an outer surface of the outer platform and the upper surface of the slot is substantially uniform along an entire length of the slot, a second thickness between an inner surface of the outer platform and the lower surface of the slot varies over the length of the slot to define the varying spacing between the upper and lower surfaces and the slot includes a midpoint between the closed first and second ends with the second thickness varying axially forward of the midpoint and remaining substantially uniform aft of the midpoint; and a seal disposed within the adjacent slots of adjacent ones of the plurality of vane segments.

2. The vane assembly as recited in claim 1, including a slot on each of the pressure side and suction side of the outer platform.

3. The vane assembly as recited in claim 1, wherein a thickness of the seal is substantially uniform along an entire length of the seal.

4. A gas turbine engine comprising the vane assembly of claim 1.

5. A vane segment for a gas turbine engine comprising:

an airfoil defining a pressure side and a suction side;

a platform extending transverse to the airfoil; and a slot for receiving a seal, the slot including closed first and second ends and an upper surface spaced apart from a lower surface wherein a spacing between the upper surface and the lower surface varies along a length of the slot, a first thickness between an outer surface of the platform and the upper surface of the slot is substantially uniform along an entire length of the slot, a second thickness between an inner surface of the platform and the lower surface of the slot varies over the length of the slot to define the varying spacing between the upper and lower surfaces and the slot comprises a midpoint between the closed first and second ends with the second thickness varying axially forward of the midpoint and substantially uniform aft of the midpoint.

6. The vane segment as recited in claim 5, including a slot on each of the pressure side and suction side of the platform.

7. The vane segment as recited in claim 5, including an outer platform and an inner platform, wherein the outer platform is radially outward of the inner platform, and wherein the slot is defined in the outer platform.

* * * * *